United States Patent [19]

Roling et al.

[11] Patent Number: 4,894,139

[45] Date of Patent: Jan. 16, 1990

[54] METHODS FOR DEACTIVATING COPPER IN HYDROCARBON FLUIDS

[75] Inventors: Paul V. Roling, Spring; Dwight K. Reid, Houston, both of Tex.; Joseph H. Y. Niu, Wanaque, N.J.

[73] Assignee: Betz Laboratories, Inc., Trevose, Pa.

[21] Appl. No.: 198,011

[22] Filed: May 24, 1988

Related U.S. Application Data

[63] Continuation-in-part of Ser. No. 904,598, Sep. 5, 1986, Pat. No. 4,749,468.

[30] Foreign Application Priority Data

May 28, 1987 [CA] Canada ..... 538373
Aug. 21, 1987 [EP] European Pat. Off. ..... 87307421.5

[51] Int. Cl.[4] ..... C10G 21/00

[52] U.S. Cl. ..... 208/48 AA; 208/48 R; 208/251 R; 208/255; 252/51; 423/DIG. 14; 585/950

[58] Field of Search ..... 208/48 AA, 48 R, 47, 208/255, 251 R; 585/950; 44/640; 423/DIG. 14; 252/51 R

[56] References Cited

U.S. PATENT DOCUMENTS

| | | | |
|---|---|---|---|
| Re. 26,330 | 1/1968 | Colfer | 208/48 |
| 2,347,626 | 4/1944 | Bradley | 106/273 |
| 2,353,192 | 7/1944 | Sargent et al. | 44/62 |
| 2,553,441 | 5/1951 | Chenicek | 99/163 |
| 2,962,442 | 11/1960 | Andress | 252/51.5 |
| 3,023,161 | 2/1962 | Luvisi et al. | 208/251 |
| 3,034,876 | 5/1962 | Gee et al. | 44/62 |
| 3,050,461 | 8/1962 | Luvisi | 208/251 |
| 3,068,083 | 12/1962 | Gee et al. | 44/70 |
| 3,132,085 | 5/1964 | Summers, Jr. | 208/48 |
| 3,200,106 | 8/1965 | Dickson et al. | 260/97.5 |
| 3,214,376 | 10/1965 | Morway | 252/18 |
| 3,225,099 | 12/1965 | Coffield | 260/570.9 |
| 3,235,484 | 2/1966 | Colfer | 208/48 |
| 3,269,810 | 8/1966 | Chamot | 44/62 |
| 3,342,723 | 9/1967 | Godar | 208/48 AA |
| 3,355,270 | 11/1967 | Amick et al. | 44/68 |
| 3,368,972 | 2/1968 | Otto | 252/47.5 |
| 3,413,347 | 11/1968 | Worrel | 260/570.5 |
| 3,437,583 | 4/1969 | Gonzalez | 208/48 |
| 3,442,791 | 5/1969 | Gonzalez | 208/48 |
| 3,756,943 | 9/1973 | Hopkins et al. | 208/143 |
| 3,787,458 | 1/1974 | Piasek et al. | 260/404.5 |
| 3,980,569 | 9/1976 | Pindar et al. | 252/51.5 R |
| 3,985,802 | 10/1976 | Plasek et al. | 260/553 A |
| 4,020,048 | 4/1977 | Harrop | 260/51.5 |
| 4,032,304 | 6/1977 | Dorer, Jr. et al. | 44/70 |
| 4,157,308 | 6/1977 | Wilgus et al. | 252/42.7 |
| 4,157,309 | 6/1979 | Wilgus et al. | 252/42.7 |
| 4,166,726 | 9/1979 | Harle | 44/73 |
| 4,170,562 | 10/1979 | West | 252/51.5 A |
| 4,200,545 | 4/1980 | Clason et al. | 252/33.4 |
| 4,242,212 | 12/1980 | Hanson | 252/51.5 R |
| 4,396,517 | 8/1983 | Gemmill, Jr. et al. | 252/51.5 R |
| 4,409,408 | 10/1983 | Miller | 585/950 |
| 4,434,307 | 2/1984 | Miller | 585/950 |
| 4,456,526 | 6/1984 | Miller | 208/48 AA |
| 4,511,457 | 4/1985 | Miller et al. | 585/950 |
| 4,539,099 | 9/1985 | Merchant et al. | 208/177 |
| 4,548,725 | 10/1985 | Bridger | 252/56 R |
| 4,628,132 | 12/1986 | Miller | 585/950 |
| 4,666,683 | 5/1987 | Brown et al. | 423/24 |
| 4,749,468 | 6/1988 | Roling et al. | 208/48 AA |

FOREIGN PATENT DOCUMENTS 1158076 7/1969 United Kingdom .

OTHER PUBLICATIONS

Pedersen, C. J., "Inhibition of Deterioration of Cracked Gasoline During Storage", *Industrial and Engineering Chemistry*, 41:924–928 (May, 1949).

*Primary Examiner*—Helane Myers
*Attorney, Agent, or Firm*—Alexander D. Ricci; Roslyn T. Tobe

[57] ABSTRACT

Certain Mannich reaction products formed from the reaction of an alkyl substituted catechol, a polyamine, and an aldehyde are used to deactivate copper metal species contained in hydrocarbon fluids. Left untreated, such copper species lead to decomposition resulting in the formation of gummy, polymer masses in the hydrocarbon liquid.

18 Claims, No Drawings

METHODS FOR DEACTIVATING COPPER IN HYDROCARBON FLUIDS

RELATED APPLICATION

This application is a continuation-in-part of U.S. patent application Ser. No. 904,598 filed Sept. 5, 1986now U.S. Pat. No. 4,749,468.

BACKGROUND OF THE INVENTION

This invention relates to the use of chelating molecules to deactivate copper species to prevent fouling in hydrocarbon fluids.

In a hydrocarbon stream, saturated and unsaturated organic molecules, oxygen, peroxides, and metal compounds are found, albeit the latter three in trace quantities. Of these materials, peroxides can be the most unstable, decomposing at temperatures from below room temperature to above room temperature depending on the molecular structure of the peroxide (G. Scott, "Atmospheric Oxidation and Antioxidants", published by Elsevier Publishing Co., N.Y., 1965).

Decomposition of peroxides will lead to free radicals, which then can start a chain reaction resulting in polymerization of unsaturated organic molecules. Antioxidants can terminate free radicals that are already formed.

Metal compounds and, in particular, transition metal compounds such as copper can initiate free radical formation in three ways. First, they can lower the energy of activation required to decompose peroxides, thus leading to a more favorable path for free radical formation. Second, metal species can complex oxygen and catalyze the formation of peroxides. Last, metal compounds can react directly with organic molecules to yield free radicals.

The first row transition metal species manganese, iron, cobalt, nickel, and copper are already found in trace quantities (0.01 to 100 ppm) in crude oils, in hydrocarbon streams that are being refined, and in refined products. C. J. Pedersen (Inc. Eng. Chem., 41, 924–928, 1949) showed that these transition metal species reduce the induction time for gasoline, an indication of free radical initiation. Copper compounds are more likely to initiate free radicals than the other first row transition elements under these conditions.

To counteract the free radical initiating tendencies of the transition metal species and, in particular, copper, so called metal deactivators are added to hydrocarbons with transition metal species already in the hydrocarbon. These materials are organic chelators which tie up the orbitals on the metal rendering the metal inactive. When metal species are deactivated, fewer free radicals are initiated and smaller amounts of antioxidants would be needed to inhibit polymerization.

Not all chelators will function as metal deactivators. In fact, some chelators will act as metal activators. Pedersen showed that while copper is deactivated by many chelators, other transition metals are only deactivated by selected chelators.

PRIOR ART

Schiff Bases such as N,N'-salicylidene-l,2-diaminopropane are the most commonly used metal deactivators. In U.S. Pat. Nos. 3,034,876 and 3,068,083, the use of this Schiff Base with esters were claimed as synergistic blends for the thermal stabilization of jet fuels.

Gonzalez, in U.S. Pat. No. 3,437,583 and 3,442,791, claimed the use of N,N'-disalicylidene-l,2-diaminopropane in combination with the product from the reaction of a phenol, an amine, and an aldehyde as a synergistic antifoulant. Alone the product of reaction of the phenol, amine, and aldehyde had little, if any, antifoulant activity.

Products from the reaction of a phenol, an amine, and an aldehyde (known as Mannich-type products) have been prepared in many ways with differing results due to the method of preparation and due to the exact ratio of reactants and the structure of the reactants.

Metal chelators were prepared by a Mannich reaction in U.S. Pat. No. 3,355,270. Such chelators were reacted with copper to form a metallic chelate complex which metallic complex was then added to the furnace oil as a catalyst to enhance combustion. The activity of the copper was not decreased or deactivated by the Mannich reaction chelator.

Sargent et al. U.S. Pat. No. 2,353,192, and Otto, U.S. Pat. No. 3,368,972, teach that Mannich products can be prepared from allkyl substituted catechols. However, such products are not actually prepared. The alkylphenol Mannich products that are prepared in these two patents are used in finished products, where detectable amounts of transition metals are initially absent, as stabliziers against oxidation.

Mannich-type products were used as dispersants in U.S. Pat. Nos. 3,235,484, Re. 26,330, 4,032,304 and 4,200,545. A Mannich-type product in combination with a polyalkylene amine was used to provide stability in preventing thermal degradation of fuels in U.S. Pat. No. 4,166,726.

Copper, but not iron, is effectively deactivated by metal chelators such as N,N'-disalicylidene-l,2-diaminopropane. Mannich-type products, while acting as chelators for the preparation of catalysts or as dispersants, have not been shown to be copper ion deactivators.

DESCRIPTION OF THE INVENTION

Accordingly, it is an object of the inventors to provide an effective copper deactivator for use in hydrocarbon mediums so as to inhibit free radical formation during the high temperature (e.g., 100°–1000° F., commonly 600°–1000° F.) processing of the hydrocarbon fluid. It is an even more specific object to provide an effective copper deactivator that is capable of performing efficiently even when used at low dosages.

We have found that copper is effectively deactivated by the use of certain Mannich-type products formed via reaction of the reactants (A), (B), and (C); wherein (A) is an alkyl substituted catechol of the structure

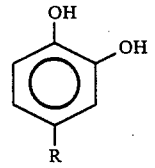

FORMULA (I)

wherein R is selected from alkyl, aryl, alkaryl, or arylalkyl of from about 1 to 20 carbon atoms; wherein (B) is a polyamine of the structure

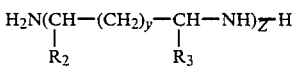

FORMULA (II)

wherein Z is a positive integer, $R_2$ and $R_3$ may be the same or different and are independently selected from H, alkyl, aryl, aralkyl, or alkaryl having from 1 to 20 carbon atoms, y may be 0 or 1; and wherein (C) is an aldehyde of the structure

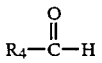

FORMULA (III)

wherein R4 is selected from hydrogen and alkyl having from 1 to 6 carbon atoms.

As to exemplary compounds falling within the scope of Formula I supra, 4-methylcatechol, 4-ethylcatechol, 4-t-butylcatechol (TBC), 4-t-amylcatechol, 4-t-octylcatechol, 4-dodecylcatechol, and 4-nonylcatechol may be mentioned. At present, it is preferred to us 4-t-butylcatechol (TBC) as the Formula I component.

Exemplary polyamines which can be used in accordance with Formula II include ethylenediamine (EDA), propylenediamine, diethylenetriamine (DETA), triethylenetetramine (TETA), tetraethylenepentamine (TEPA) and the like, with diethylenetriamine (DETA) and triethylenetetramine (TETA) being preferred.

The aldehyde component can comprise, for example, formaldehyde, acetaldehyde, propanaldehyde, butrylaldehyde, hexaldehyde, heptaldehyde, etc. with the most preferred being formaldehyde which may be used in its monomeric form, or, more conveniently, in its polymeric form (i.e., paraformaldehyde).

As is conventional in the art, the condensation reaction may proceed at temperatures from about 50° to 200° C. with a preferred temperature range being about 75°-175° C. As is stated in U.S. Pat. No. 4,166,726, the time required for completion of the reaction usually varies from about 1-8 hours, varying of course with the specific reactants chosen and the reaction temperature.

As to the molar range of components (A):(B):(C) which may be used, this may fall within 0.5-5:1:0.5-5.

The copper deactivators of the invention may be dispersed within the hydrocarbon medium containing the troublesome metal species within the range of about 0.05 to 50,000 ppm based upon one million parts of the hydrocarbon medium. Preferably, the copper deactivator is added in an amount from about 1 to 10,000 ppm. A Mannich product-metal complex is formed in situ upon Mannich product addition to the hydrocarbon medium. The complex deactivates the metal so as to inhibit free radical formation.

EXAMPLES

The invention will now be further described with referece to a number of specific examples which are to be regarded solely as illustrative and not as restricting the scope of the invention.

TESTING METHOD

The peroxide test method was employed to determine the deactivating ability of the chelators. The peroxide test involves the reaction of a metal compound, hydrogen peroxide, a base, a metal chelator. In the presence of a base, the metal species will react with the hydrogen peroxide yielding oxygen. When a metal chelator is added, the metal can be tied up resulting in the inhibition of the peroxide decomposition or the metal can be activated resulting in the acceleration of the rate of decomposition. The less oxygen generated in a given amount of time, the better the metal deactivator.

A typical test is carried out as follows: In a 250-mL two-necked, round-bottomed flask equipped with an equilibirating dropping funnel, a gas outlet tube, and a magnetic stirrer, was placed 10 mL of 3% (0.001 mol) hydrogen peroxide in water, 10 of a 0.01 M (0.0001 mol) copper naphthenate in xylene solution, and metal deactivator. To the gas outlet tube was attached a water-filled trap. The stirrer was started and kept at a constant rate to give good mixing of the water and organic phases. Ammonium hydroxide (25 mL of a 6% aqueous solution) was placed in the dropping funnel, the system was closed, and the ammonium hydroxide added to the flask. As oxygen was evolved, water was displaced, with the amount being recorded as a factor of time. A maximum oxygen evolution was 105 mL.

With metal species absent, oxygen was not evolved over 10 minutes. With 10 mL of a 0.010 M copper napthenate in xylene solution, 105 mL of oxygen was evolved in 30 seconds or less, showing the peroxide decomposing ability of undeactivated copper.

EXAMPLE 1

A 3:1:3 mole ratio of tert-butylcatechol (TBC):ethylenediamine (EDA):paraformaldehyde was prepared as follows. In a three-necked, round-bottomed flask equipped with a mechanical stirrer, a reflux condenser and a thermometer., was placed 49.86 g (0.3 mol) of TBC, 9.45 g (0.3 mol) of paraformaldehyde (95% purity), and 60 g of toluene. On addition of the 6.01 g (0.1 mol) of EDA, the temperature rose to 82° C. The mixture was held at 70° C. for 1 hour. A Dean Stark trap was inserted between the condenser and the flask and the temperature was increased to 110° C., at which time water of formation was azeotroped off—5.3 mL was collected (approximately the theoretical amount). The mixture was cooled to room temperature, the toluene returned to the mixture, and the mixture used as is at 50% actives.

When 100 mg (0.17 mol) of the actives in the above mixture was used in the peroxide test, only 34 mL of oxygen was evolved in 5 minutes. At a molar ratio of 1.7:1.0 of product:copper, the copper was substantially deactivated by this product, when compared to the control of 105 mL of oxygen evolved in 30 seconds or less. At a lower molar ratio of 0.85:1.0 of product:copper where some copper would remain unchelated, three peroxide tests showed an average of 59 mL of oxygen evolved in 5 minutes.

EXAMPLE 2

A 3:1:3 mole ratio of tert-butylcatechol (TBC):dietnylenetriamine (DETA):paraformaldehyde was prepared as follows. In a three-necked, round bottomed flask, equipped with a mechanical stirrer, a reflux condenser and a thermometer; was placed 49.86 g (0.3 mol) of TBC, 9.45 (0.3 mol) of paraformaldehyde (95% purity), and 64.3 g of toluene. On addition of the 10.32 g (0.1 mol) of DETA, the temperature rose to 75° C. The mixture was held at 70° C. for 1 hour. A Dean Stark trap was inserted between the condenser and the flask and the temperature was increased to 110° C., at which time water of formation was azeotroped off—5.6 mL was collected (approximately the theoretical amount).

The mixture was cooled to room temperaure, the toluene returned to the mixture, and the mixture used as is at 50% actives.

When 100 mg (0.16 mmol) of the actives in the above mixture was used in the peroxide test, 0 mL of oxygen was evolved in 5 minutes. At a molar ratio of 1.6:1.0 of product:copper, the copper was deactivated by this product, when compared to the control of 105 mL of oxygen evolved in 30 seconds or less. At a lower molar ratio of 0.8:1.0 of product:copper where some copper would remain unchelated, three peroxide tests showed an average of 38 mL of oxygen evolved in 5 minutes. And finally at an even lower molar ratio of 0.4:1.0 of product:copper where most of the copper would remain unchelated, two peroxide tests showed an average of 99 mL of oxygen evolved in 5 minutes.

EXAMPLE 3

A 4:1:4 mole ratio of tert-butylcatechol(TBC):triethylenetetramine (TETA):paraformaldehyde was prepared as follows. In a three-necked, round-bottomed flask, equipped with a mechanical stirrer, a reflux condenser and a thermometer; was placed 29.92 g (0.18 mol) of TBC, 5.67 (0.18 mol) of paraformaldehyde (95% purity), and 33.7 g of diethylene glycol dimethyl ether (diglyme). On addition of the 6.58 g (0.045 mol) of TETA, the temperature rose to 53° C. The mixture was held at 70° C. for 1 hour. A Dean Stark trap was inserted between the condenser and the flask and the temperature was increased to 151° C., at which time water of formation was azeotroped off—7.3 mL was collected (approximately the theoretical amount). The mixture was cooled to room temperature, the toluene returned to the mixture, and the mixture used as is at 50% actives.

When 100 mg (0.12 mmol) of the actives in the above mixture was used in the peroxide test, 0 mL of oxygen was evolved in 5 minutes. At a molar ratio of 1.2:1.0 of product:copper, the copper was deactivated by this product, when compared to the control of 105 mL of oxygen evolved in 30 seconds or less. At a lower molar ratio of 0.9:1.0 of product:copper where some copper would remain unchelated, the peroxide test snowed 6 mL of oxygen evolved in 5 minutes. At an even lower molar ratio of 0.6:1.0 of product:copper where more copper would remain unchelated, two peroxide tests showed an average of 39 mL of oxygen evolved in 5 minutes. At a lower molar ratio of 0.045:1.0 of product:copper where most of the copper would remain unchelated, the peroxide test showed 90 mL of oxygen evolved in 5 minutes. And finally, at a lower molar ratio of 0.03:1.0 of product:copper where most of the copper would remain unchelated, the peroxide test showed 91 mL of oxygen evolved in 5 minutes.

These three examples snow that copper deactivation occurs with all of the products, although better deactivation occurs with DETA and TETA. The preferred molar ratio of product:copper is about 1:1 or greater.

Reasonable variations and modifications which will be apparent to those skilled in the art can be made without departing from the spirit and scope of the invention.

What is claimed is:

1. A method of deactivating a copper species already present in a hydrocarbon medium during high temperature processing, wherein in the absence of said deactivating method said copper would initiate decomposition of the hydrocarbon medium, said method comprising adding to said hydrocarbon medium an effective amount to deactive said copper species of an effective Mannich reaction product formed by reaction of reactants (A), (B), and (C), wherein (A) comprises an alkyl substituted catechol of the structure

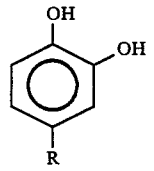

FORMULA I wherein R is selected from the alkyl, aryl, alkaryl, or arylalkyl of from about 1 to 20 carbon atoms (B) comprises a polyamine of the structure $$H_2N(\underset{\underset{R_2}{|}}{CH}-(CH_2)_y-\underset{\underset{R_3}{|}}{CH}-NH)_zH$$

FORMULA II wherein z is a positive integer, $R_2$ and $R_3$ are the same or different and are independently selected from H, alkyl, aryl, aralkyl, or alkaryl having from 1 to 20 carbon atoms, y being 0 or 1; and (C) comprising an aldehyde of the structure $$R_4-\overset{\overset{O}{\|}}{C}-H$$

FORMULA III wherein $R_4$ comprises H or $C_1$–$C_6$ alkyl.

2. A method as recited in claim 1, wherein the molar ratio of reactants (A):(B):(C) is about 0.5–5:1:0.5–5.

3. A method as recited in claim 2 wherein said Mannich reaction product is added to said hydrocarbon medium in an amount of from about 0.5 to about 50,000 ppm based upon one million parts of said hydrocarbon medium.

4. A method as recited in claim 3 wherein said Mannich reaction product is added to said hydrocarbon medium in an amount of about 1 to about 10,000 ppm based upon one million parts of said hydrocarbon medium.

5. A method as recited in claim 4 wherein said hydrocarbon medium is heated at a temperature of from about 100° to about 1000° F.

6. A method as recited in claim 5 wherein said hydrocarbon medium is heated at a temperature of about 600° to about 1000° F.

7. A method as recited in claim 6 wherein said alkyl substituted catechol (A) comprises a member or members selected from the group consisting of 4-methylcatechol, 4-ethylcatechol, 4-t-butylcatechol, 4-t-amylcatechol, 4-t-octylcatechol, 4-dodecylcatechol, and 4-nonylcatechol.

8. A method as recited in claim 6 wherein said polyamine (B) is selected from the group consisting of diethylenetriamine and triethylenetetramine.

9. A method as recited in claim 6 wherein said aldehyde (C) is selected from the group consisting of formaldehyde and paraformaldehyde.

10. A method of inhibiting the formation of free radicals in a hydrocarbon medium by deactivating a copper species contained in said hydrocarbon medium during high temperature processing wherein in the absence of said deactivating, said copper species would initiate formation of free radicals in said hydrocarbon medium in turn leading to decomposition of said hydrocarbon medium, said method comprising inhibiting said formation of free radicals by adding to said hydrocarbon medium which already contains said copper species, an effective amount to deactivate said copper of an effective Mannich reaction product formed by reaction of reactants (A), (B) and (C), wherein (A) comprises an alkyl substituted catechol selected from the group consisting of 4-methyl-catechol, 4-ethylcatechol, 4-butylcatechol, 4-amylcatechol, 4-t-octylcatechol, 4-dodecylcatechol and 4-nonylcatechol; (B) comprises a polyamine selected from the group consisting of diethylenetriamine and triethylenetriamine; and (C) comprises an aldehyde selected from the group consisting of formaldehyde and paraformaldehyde.

11. A method as recited in claim 10 wherein the molar ratio of reactants (A):(B):(C) is about 0.5–5:1:0.5–5.

12. A method as recited in claim 11 wherein the molar ratio of ractants (A):(B):(C) falls within the range of 3–4:1:3–4.

13. A method as recited in claim 12 wherein (A) comprises 4-t-butylcatechol, (B) comprises diethylenetriamine and (C) comprises formaldehyde or paraformaldehyde and the molar ratio of reactants (A):(B):(C) is about 3:1:3.

14. A method as recited in claim 11 wherein (A) comprises 4-t-butylcatechol, (B) comprises triethylene tetramine, and (C) comprises formaldehyde or paraformaldehyde and the molar ratio of reactants (A):(B):(C) is about 4:1:4.

15. A method as recited in claim 11 wherein said Mannich reaction product is added to said hydrocarbon medium in an amount of from about 0.5 to about 50,000 ppm based upon one million parts of said hydrocarbon medium.

16. A method as recited in claim 15 wherein said Mannich reaction product is added to said hydrocarbon medium in an amount of about 1 to about 10,000 ppm based upon one million parts of said hydrocarbon medium.

17. A method as recited in claim 16 wherein said hydrocarbon medium is heated at a temperature of from about 100° to about 1000° F.

18. A method as recited in claim 17 wherein said hydrocarbon medium is heated at a temperature of about 600° to about 1000° F.

* * * * *